US005379098A

United States Patent [19]

Bennett et al.

[11] Patent Number: 5,379,098

[45] Date of Patent: Jan. 3, 1995

[54] APPARATUS AND METHOD FOR SEQUENCING A TRANSPORT SYSTEM OF AN IMAGE-PRODUCING APPARATUS

[75] Inventors: Charles J. Bennett, Hilton; Thomas T. Stetz, III, Rochester, both of N.Y.

[73] Assignee: Eastman Kodak Company, Rochester, N.Y.

[21] Appl. No.: 984,658

[22] Filed: Dec. 2, 1992

[51] Int. Cl.[6] ..... G03G 15/14

[52] U.S. Cl. ..... 355/271; 355/309; 355/317; 355/326 R

[58] Field of Search ..... 355/326 R, 204, 317, 355/309, 282, 272, 281, 212, 271; 271/182, 202, 256

[56] References Cited

U.S. PATENT DOCUMENTS 4,595,279 6/1986 Kuru et al. .
4,652,115 3/1987 Palm et al. .
4,711,552 12/1987 Nilsson et al. ..... 355/317
4,712,906 12/1987 Bothner et al. .
4,931,842 6/1990 Mahoney ..... 355/317
4,939,554 7/1990 Hirabayashi et al. ..... 355/317
4,941,021 7/1990 Uchida et al. ..... 355/326 X
5,075,732 12/1991 Menjo ..... 355/282

*Primary Examiner*—A. T. Grimley
*Assistant Examiner*—Shuk Y. Lee
*Attorney, Agent, or Firm*—J. Gary Mohr

[57] ABSTRACT

An apparatus and method for sequence a "two-up" imaging drum for four color process color is provided. The sequencing provides enough separation between the receivers to operate an image fixing station as a slower throughput speed then the linear speed of the receivers exiting the transfer station and thereby provide more fusing energy and higher image quality without appreciable loss in productivity. The sequence also provides for better registration, by maintaining the receiving member conforming to the transfer drum during the total toning process.

16 Claims, 4 Drawing Sheets

FIG. 4
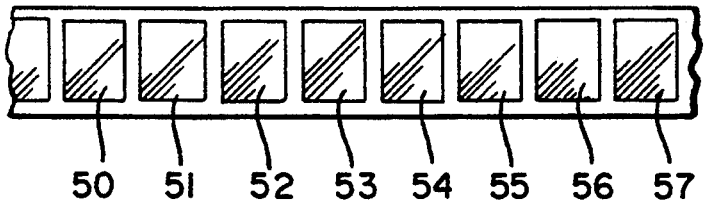
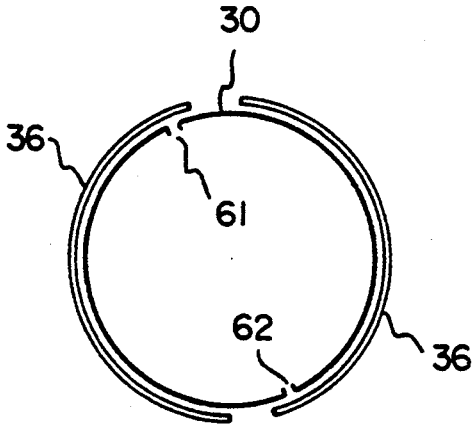
FIG. 5
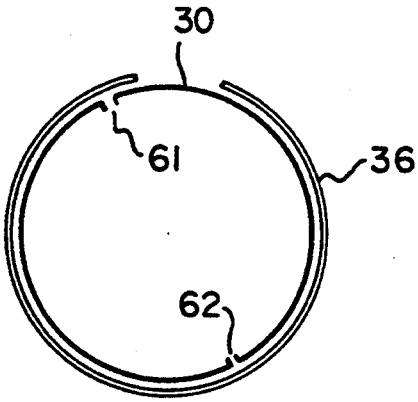
FIG. 6

APPARATUS AND METHOD FOR SEQUENCING A TRANSPORT SYSTEM OF AN IMAGE-PRODUCING APPARATUS

BACKGROUND OF THE APPARATUS

1. Field of the Invention

This invention relates, in general, to photocopying and, more specifically, to sheet transporting systems in copiers, printers, duplicators, and like devices.

2. Description of the Prior Art

Electrostatographic apparatus, such as copiers, printers, and duplicators, can have many different basic forms of construction. One type of apparatus known in the prior art has a transfer drum which was dimensioned to hold two receivers, such as copy sheets, at the same time. U.S. Pat. No. 4,712,906, which issued on Dec. 15, 1987 to the same assignee as the present invention, discloses such an apparatus. In the referenced patent, the transfer drum can handle one 11"×17" copy sheet or two 8½×11" copy sheets simultaneously. The ability to process two sheets at the same time increases the throughput speed of the machine when using the smaller sized sheets.

In the above device, however, when color copying and a two up transfer drum are employed, there is a time delay between when the first two copy sheets enter the transfer station and the time the first two copy sheets, with an image thereon, exit the transfer station in immediate succession, for transfer to the fusing station. The same time delay is repeated for each new set of copy sheets. This delay is the result of each copy sheet making more than one revolution, with the transfer drum, for transfer, in registration, all of the separate colors of the images to be copied onto the copy sheet. Usually one revolution is required for each separate toner to be applied to the copy sheet. An example of this, for three color toning, is that during the first rotation each sheet is toned with yellow, with magenta during the second revolution and with cyan during the third revolution, with said third revolution being the same revolution that the securing means, such as vacuum ports, release the copy sheet from the transfer drum. A disadvantage of such a process is that if the fusing station is operating at a slower throughput rate than the linear output rate of the transfer station, which is usually the case in a two up color transfer process, any attempt to slow down the copy sheets between the transfer station and the fusing station results in overlapping of sheets. This is especially true where the image fusing station is located only a short distance away, such as less than the width of two copy sheets, from the transfer station. A further disadvantage of such a process is that the individual copy sheets containing the finished color copy images are not delivered, for processing, uniformly to the major subsystems in the copier or paper. To compensate for this non-uniform rate, each subsystem must be constantly adjusted, in relation to changes in the other subsystems, in order to produce quality copy output. For example, if the speed of the fuser is increased, the amount of heat and release oil applied to the copy paper would be different than if the fuser were running at a slower rate of speed. To maintain consistency in the copies, a change in the temperature of the fuser would be required to compensate for such a change in speed. Thus, changing the speed of the fuser is not usually desirable without a corresponding change in the amount of heat and release oil applied to the copy sheet to compensate for such change in speed.

There are various methods that can be used to bridge the above problems. One solution is to provide a greater distance between the transfer station and the fuser station. Both sheets can then be placed upon an intermediate vacuum transport system, slowed down on said transport system and fed separately, at the slower speed, into the fuser station. This, however, increases the overall size of the copier. Another method presently used involves the use of a smaller drum that only retains one sheet of paper. This, however, prevents imaging 11"×17" paper. Still another means would be to slow down the copiers transfer station so that it operates at the same slow speed as the fuser; however, this decreases productivity.

SUMMARY OF THE INVENTION

An object of this invention is to provide a machine sequencing system that spaces the sheets released from the transfer station to allow for a speed differential between the linear speed at which the sheets exit the transfer station and the linear speed at which the sheets enter the fuser station while avoiding sheet overlap, but without appreciable loss in productivity.

Another object includes providing a higher quality, higher density image by having the fuser operated at a slower speed so that the toned images are retained for a longer duration in the nip rollers of the fuser, thereby allowing the heat and pressure of the fuser to better flow and fix the toner particles.

A further object is to have better registration of the color images transferred to the sheet from a photosensitive surface.

The above objects are accomplished by a new and useful receiver transport sequencing system for use with printers, copiers, and like devices having a two up transfer station for transferring developed images, from a first movable member having a series of image frames, to a series of receivers, said transport sequencing system comprising:

- means for delivering each receiver of the series of receivers to the transfer station separated by an interval of at least two image frames,
- means for transferring, at the transfer station, the developed images, from the image frames, in timed registration to the receivers,
- means for releasing the receivers at a first linear speed from the transfer station,
- a fuser station for fusing the transferred images to the receivers,
- means for conveying the receivers from the transfer station to the fuser station,
- means for releasing the fused receivers at a second linear speed from the fuser station, and
- means for synchronizing the delivery of the receivers to the transfer station, movement of the receivers in the transfer station, the release of the receivers from the transfer station and movement of the receivers on the conveying means to the fusing station.

An advantage of the above, for a color "two-up" transfer drum, is it provides enough separation between sheets to operate the fuser station at a slower speed. This allows the sheets to spend more time in the fusing station which results in the availability of more fusing energy for higher image quality while maintaining a relatively high level of productivity. Another advantage is better registration by having all images transferred while the receiving media is held conformed to the transfer drum.

BRIEF DESCRIPTION OF THE DRAWINGS

Further advantages and uses of this invention will become more apparent when considered in view of the following detailed description and drawings, in which:

FIG. 4 is a schematic plan view of the belt of the photosensitive surface with letter sized images thereon;

FIG. 5 is a schematic end view of the transfer drum with two letter size copy sheets attached thereto; and FIG. 6 is a schematic end view of the transfer drum with a single ledger size copy sheet attached thereto.

DESCRIPTION OF THE PREFERRED EMBODIMENTS

Figure 1:
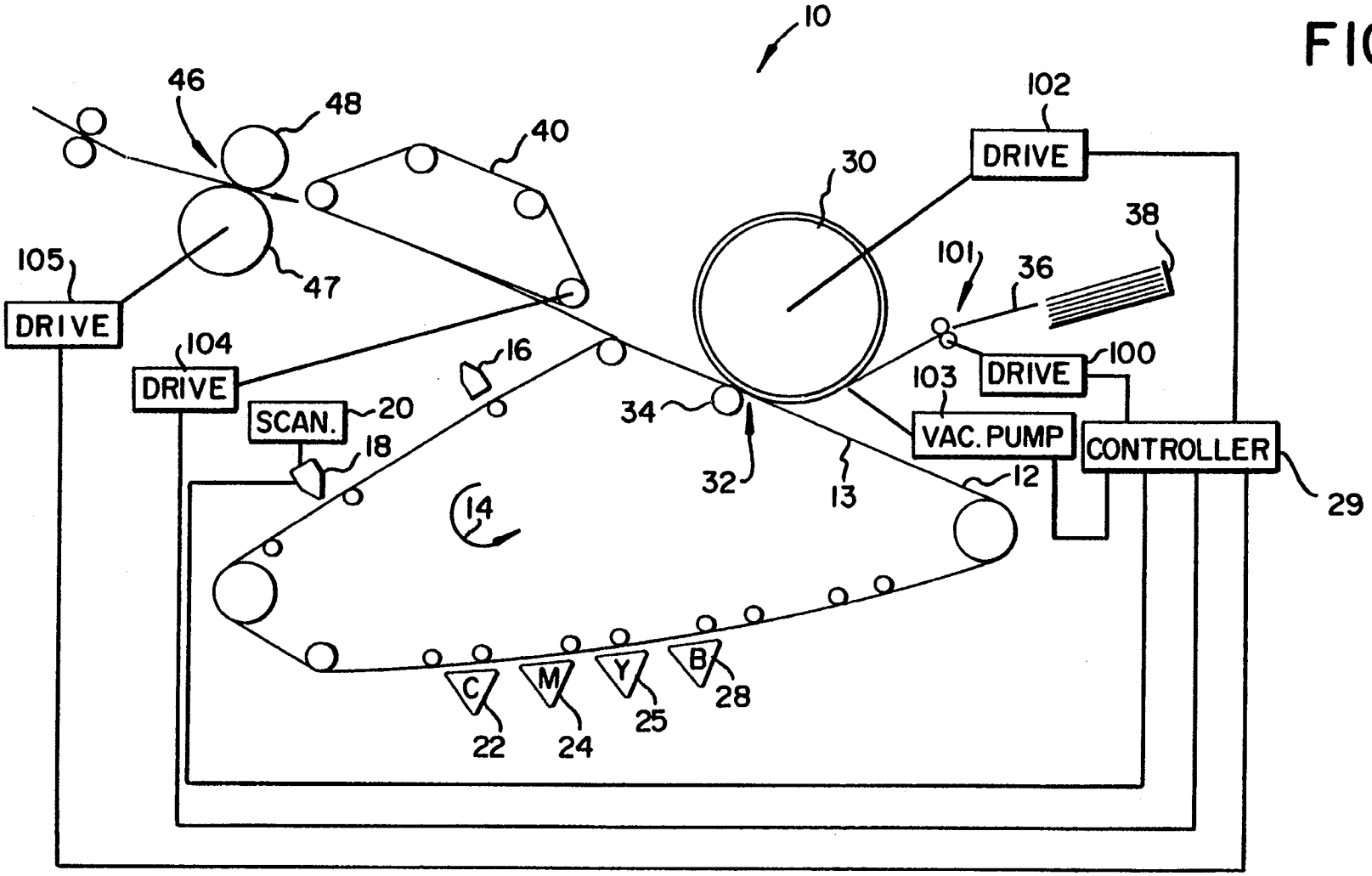
FIG. 1 is an overall schematic view of a copier wherein the invention is applicable.

The apparatus of the preferred embodiment will be described in accordance with an electrophotographic recording medium. The invention, however, is not limited to methods and apparatus for creating images on such a medium, as other media may also be used to advantage within the spirit of the invention.

Because electrophotographic reproduction apparatus are well known, the present description will be directed in particular to elements forming part of, or cooperating more directly with, the present invention. Apparatus not specifically shown or described herein are selectable from those known in the art.

While the present invention is susceptible to embodiments of many different forms, there is shown in the drawings and hereinafter described, in detail, a preferred embodiment of the invention. It should be understood, however, that the present disclosure is to be considered an exemplification of the principles of the invention and is not intended to limit the invention to the embodiments illustrated and/or described.

For ease of description, all apparatus will be described in their normal operational position, and terms such as upper, lower, horizontal, etc., will be used with reference to normal operating positions. All apparatus, however, may be manufactured, stored, transported and sold in an orientation other than the normal operational positions described.

All references cited in this specification and their references are incorporated by reference herein where appropriate, for appropriate teaching of additional or alternative details, features and/or technical background.

Throughout the following description, similar reference characters refer to similar elements or members in all of the figures of the drawings.

Referring now to the drawings, and to FIG. 1 in particular, there is shown an overall schematic view of a copier 10 adapted to use the invention. Copier 10 includes a photosensitive surface 12, on a medium 13, such as a belt or drum, which rotates in direction 14. A primary charger 16 places a predetermined charge on surface 12 and a printhead 18 is used to selectively expose photosensitive surface 12 with image information obtained from a scanner 20. The latent images formed by printhead 18 are developed by toner stations 22, 24, 26 and 28 at the appropriate time. The developed images are then transferred, in sequence and in registration, to a copy sheet 36 as it passes through transfer station 32. Transfer station 32 includes a transfer drum 30 and a secondary transfer roller 34 which can be moved into and out of engagement with belt 13 containing photosensitive surface 12. This movement provides appropriate transfer control between transfer drum 30, receiving sheet 36 and belt 13 containing photosensitive surface 12. As copy sheet 36 is removed from tray 38 and fed into transfer station 32, registered images are transferred to copy sheet 36 to form a composite image, as to be later explained, before copy sheet 36 exits transfer station 32. Upon exit of transfer station 32, copy sheet 36 is deposited onto a variable speed conveyor belt 40 which extends about rollers 42, 43, 44 and 45, for transfer to a fuser station 46 consisting of a fuser roller 47 and a pressure roller 48. It is in the sequencing of: the delivery of copy sheet 36 to transfer station 32; the transfer of images from belt 13 to copy sheet 36, at transfer station 32; the release of copy sheet 36 to conveyor 40; the control of conveyor 40 and the release of copy sheet 36 from fuser station 46, to which the present invention, as now to be explained, lies. This sequencing is controlled by controller 29, such as a microprocessor, known in the art, which is connected to drive 100 of receiver feed rollers 101, drive 102 of transfer drum 30, vacuum pump 103 of vacuum ports 61 and 62 (see FIG. 5), drive 104 of conveyor 40, printhead 18 and drive 105 of fuser station 46.

To form a complete color composite image on copy sheet 36, several revolutions of transfer drum 30, carrying copy sheet 36, are required, since images of different colors are at different frames of belt 13 containing photosensitive surface 12. In a two-up transfer system, as later to be explained, two image frames on photosensitive surface 12 are presented to transfer drum 30 during each revolution of transfer drum 30. While the invention is described herein with the use of a copier having a wrap mode transfer drum 30, it is to be understood that the invention is equally applicable to copiers with intermediate transfer drums and to other electrostatographic apparatus such as printers, duplicators and like devices. Also, belts or webs may be used in place of the drum shown, and "rotation" as used herein also applies to the movement of such web surfaces.

Figure 3:
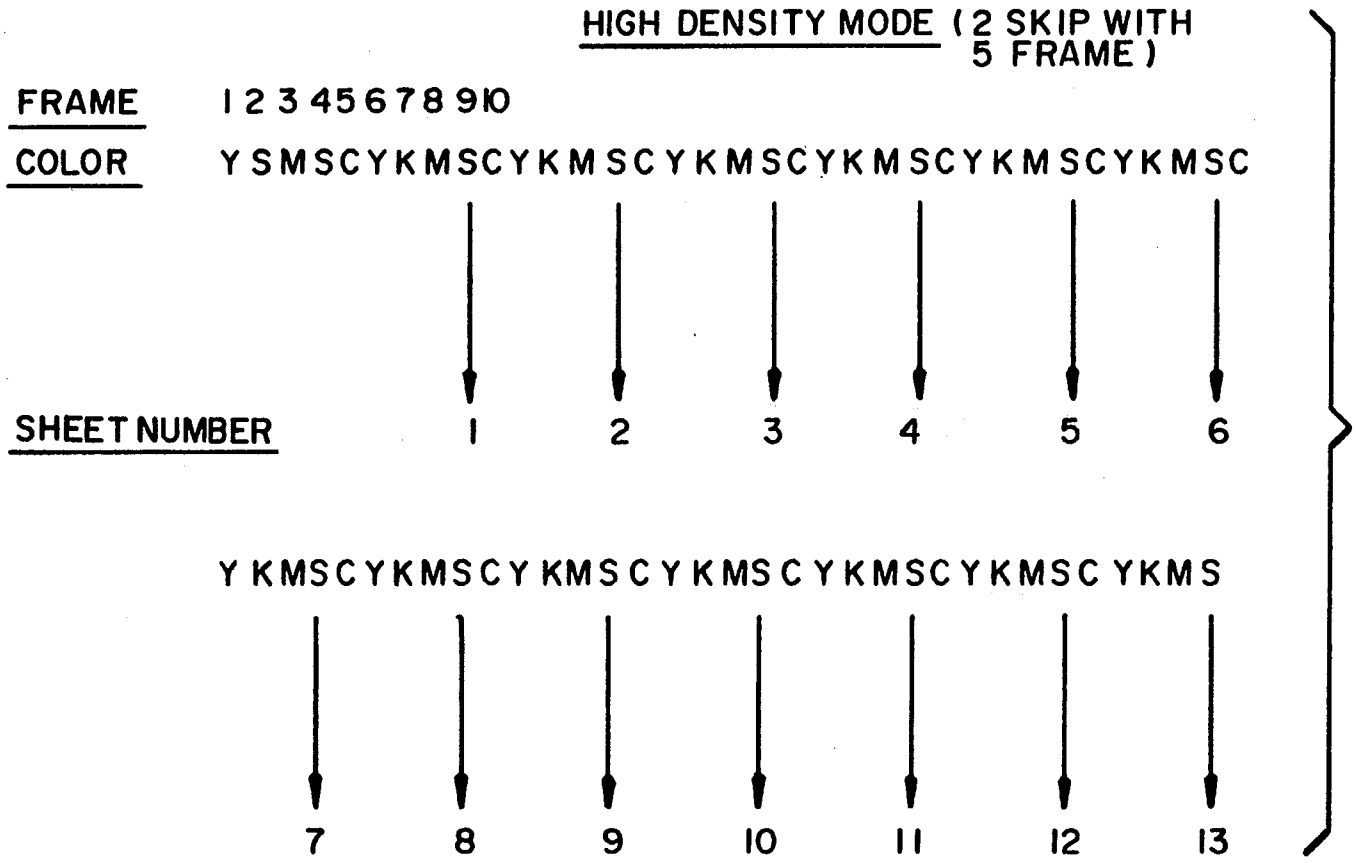
FIG. 3 is a diagram illustrating the sheet output sequencing according to the present invention.

To be versatile and applicable to many copying operations, copier 10, shown in FIG. 1, is capable of producing copies on $8\frac{1}{2}\times 11''$ copy sheets or on $11''\times 17''$ copy sheets, as shown in FIGS. 6 and 7. To accomplish this, transfer drum 30 is sized or dimensioned appropriately to retain a large sheet, which in this specific embodiment will be referred to as an $11''\times 17''$ sheet or two smaller sized sheets, such as two successive $8\frac{1}{2}\times 11''$ copy sheets. This type of transfer system is known in the art as a two-up transfer system and, as used in the present invention, operates as follows. When four toned color images are to be produced on letter size copy sheets, printhead 18 exposes photosensitive surface 12 with information to create eight frames of image information, 50–57, arranged on surface 12 of belt 13 (see FIG. 4) with their short dimensions parallel to the direction of movement and their long dimensions across the direction of movement. While the information containing frames have been numbered consecutively, a frame bearing the letter S in FIG. 3 would not contain or be exposed to image information, since it is a skip or non-toning frame for sequencing purposes, as later to be explained. Image frames 50, 52, 54 and 56, for example, are the yellow, magenta, cyan and black components of one multicolor image and image frames 51, 53, 55 and 57 are the comparable components for a second multicolor image. Copy sheets 36 are fed, at predetermined times, out of copy sheet supply 38 with their short dimension parallel to the path of travel. Once fed from supply 38, copy sheets 36 are fed into the nip of transfer station 32 with the leading edge of the first copy sheet being secured, by known means, such as vacuum ports 61, and the leading edge of the second copy sheet being secured by a second set of vacuum ports 62 (see FIGS. 5 and 6). Drum 30 rotates, in a four color toner process, with first copy sheet 36, through five revolutions or nine image frames of photosensitive surface 12, contained on belt 13 as illustrated in FIG. 3. During the first four full revolutions various color toners are laid down on first copy sheet 36 and at the start of the fifth revolution first copy sheet 36 is released from drum 30 during a skip frame. A second sheet enters the nip of transfer station 32 during the third revolution of drum 30 or on the sixth image frame, after first sheet 36 has been toned with yellow, magenta and cyan. With consecutive revolutions thereafter, second sheet 36 is toned with the yellow and magenta toner while first sheet 36 is toned with black before first sheet 36 exits the nip of transfer station 32, during a skip frame. As first sheet 36 exits during the skip frame, second sheet 36 is toned with cyan. Therefore, second sheet 36 must still be toned with black, after first sheet 36 has exited the nip of transfer station 32, before second sheet 36 may be released from transfer station 32 during a skip frame. As each sheet 36, after being fully toned, is released, during a skip frame, another sheet 36 replaces it one drum revolution later. With this type of sequencing of the toned transfer to sheet 36, a completely toned sheet 36 is released from drum 30 every five image frames, subsequent to the initial release of the first completely toned sheet 36. In other words, a sheet 36 enters and attaches to drum 30, of transfer station 32, during an image frame designated by the formula $5n-4$ and is released from transfer station 32 during an image frame designated by the formula $5n+4$, where n represents the sequence number of each copy sheet 36, in the series of copy sheets to be processed. In this manner only one sheet 36 is released every five image frames or every two and one-half revolutions of drum 30, as opposed to releasing two sheets during one revolution and then not releasing another two sheets for more than three revolutions thereafter, as done in the prior art. With this type of release sequence there is sufficient time for each individually released sheet 36 to be deposited onto conveyor 40 as conveyor 40 runs at the linear speed that sheet 36 exits transfer station 32. Conveyor 40 can then be slowed down to the throughput speed of fusing station 46 to allow for each individual sheet 36 to smoothly enter fusing station 46 and be removed from conveyor 40 as sheet 36 enters fusing station 46. After removal of sheet 36 from conveyor 40, the speed of conveyor 40 is increased to the speed of transfer station 32 before a subsequent sheet 36 is deposited onto conveyor 40. All this takes place within the time it takes a subsequent sheet 36, traveling with transfer drum 30, to make two and one-half revolutions. The above timing sequence prevents sheet overdamp without a substantial loss of productivity. In addition, since each sheet 36 is released during a skip frame better registration is obtained. This is because the last toner to be laid down on sheet 36, is laid down while sheet 36 is still conforming to drum 30, thereby being identical to how all prior toners were laid down on sheet 36. This is different than the prior art, where the initial series of toners are laid down while sheet 36 conforms to drum 30 and the last toner is laid down as sheet 36 releases from drum 30. The door art sequence created a problem of last image misregistration. Last image mis-registration being caused by the surface speed of belt 13, in relation to sheet 36 when conforming to transfer drum 30, not being equivalent to the surface speed of belt 13, in relation to sheet 36 when releasing from transfer drum 30. By maintaining sheet 36 conforming to drum 30 during the last image toning, a 10 to 40% improvement in image registration is obtained over toning the last image as sheet 36 is released from drum 30.

Figure 2:
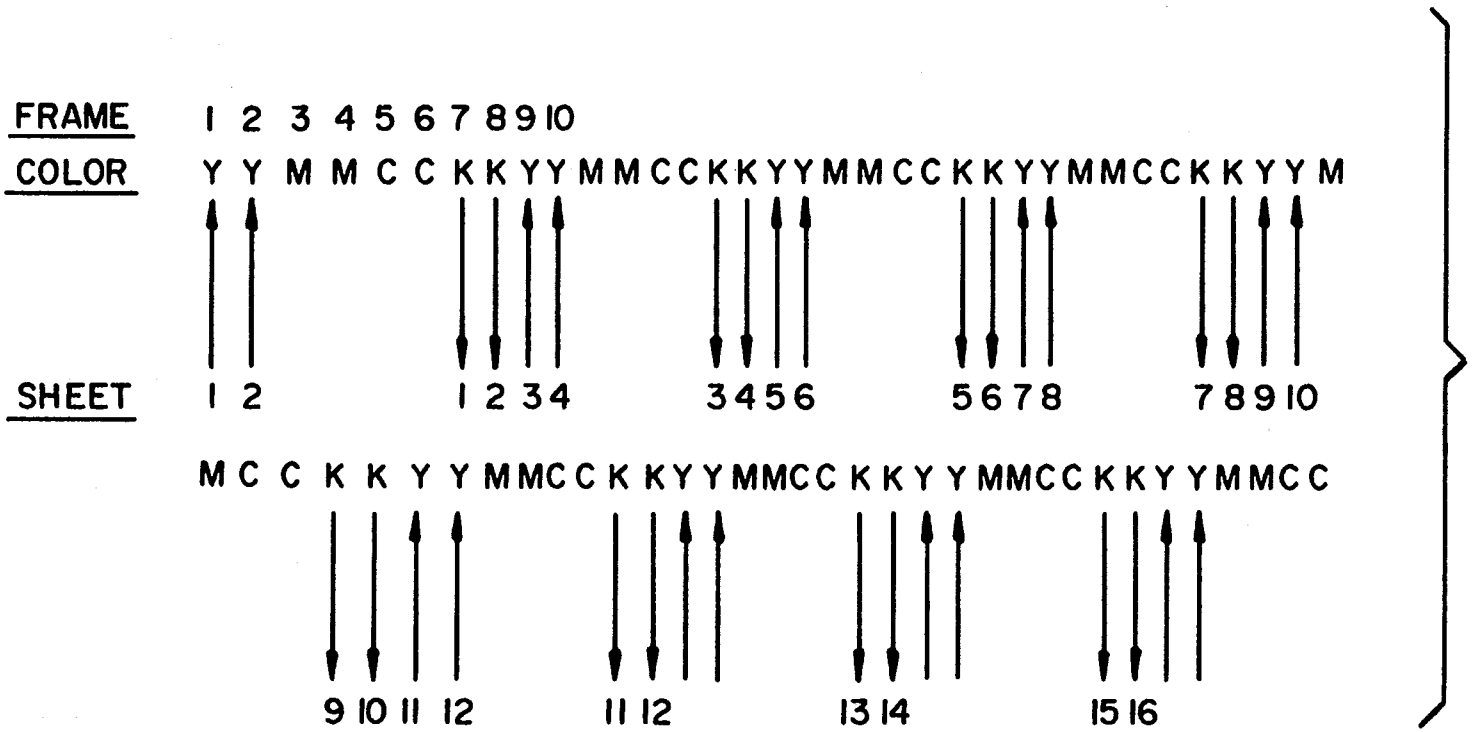
FIG. 2 PRIOR ART
FIG. 2 is a diagram illustrating a sheet output sequencing according to the prior art.

Conveyor belt 40 is the transport system for moving each individual sheet 36 between transfer station 32 and fuser station 46. FIG. 2 illustrates the prior art rate of sheet output from fuser station 46 for a two-up color copier. This prior art sequencing uses a gap of six image frames between the output of subsequent sets of copy sheets in immediate succession. The present sequencing, as illustrated in FIG. 3, unlike the prior art system, provides a constant copy output of one sheet every five image frames, after first copy sheet output. With the present sequencing, the ratio of the speed differential between the transfer and fusing apparatus can be up to 4 to 1, which is sufficient to allow conveyor 40, with an effective conveying length of only 13.5 inches, to reduce the speed of copy sheet 36, from its exit speed at transfer station 32 to a speed that matches the throughput speed of fuser station 46, without sheet overlap. This slowing down of copy sheet 36, on conveyor 40, from the initial linear exit speed of transfer station 32, to the slower throughput speed of fuser station 46, allows fuser station 46 to run at a slower rate than transfer station 32, and thereby produces a higher quality, higher density image by maintaining each toned sheet 36 in the nip between fuser roller 47 and pressure roller 49, of fuser station 46, for a longer duration. This allows the heat and pressure, in said nip, to better flow and fix the toner particles. In addition to retaining each copy sheet 36 for a longer period of time in the nip, since sheets 36 can now be fed at a uniform rate, as opposed to two sheets in quick succession followed by an extended gap, the heat, release oil and pressure additions within the nip may be kept uniform.

In operation, as shown by FIG. 1 and the sequencing of FIG. 3, when images are to be produced on letter size copy sheets 36, printhead 18 exposes photosensitive surface 12 of belt 13 with information to create eight informational images on frames 50 to 57 (see FIG. 4), which process is repeated until the required number of receivers to be processed are produced. The images on frames 50 to 57 have their short dimension parallel to the direction of movement and long dimension across the direction of movement. A single copy sheet 36 is then fed out of copy sheet supply 38, with its short dimension parallel to the path of travel, and into the nip of transfer station 32 with its leading edge held by vacuum ports 61. This single copy sheet 36 then rotates with drum 30 for five image frames, during which it is toned with yellow, magenta and cyan. At image frame six a second copy sheet 36 is fed out of copy sheet supply 38, with its short dimension parallel to the path of travel, into the nip of transfer station 32 with its leading edge being held by vacuum ports 62. Transfer drum 30, now rotates with both copy sheets 36 secured to it as first copy sheet 36 is toned with black and second copy sheet 36 is toned with yellow and magenta. First copy sheet 36 is then released from drum 30, during the ninth image frame, by the release of the vacuum at vacuum ports 61, which allows first sheet 36 to exit the nip of transfer station 32 One revolution after first sheet 36 is released, the leading edge of a third copy sheet 36 is fed into the nip of transfer station 32 to be retained by vacuum ports 61. Second sheet 36 and third sheet 36 then rotate together for three image frames when second sheet 36, after being toned with black, is released, during a skip frame, by vacuum ports 62, to exit the nip of transfer station 32. The fourth sheet 36 is then fed into the nip of transfer station 32, during the revolution following the release of second sheet 36, to be retained by vacuum ports 62. This operation is repeated with a different sheet 36 being released and retained each two and one-half revolutions of drum 30 or five image frames of belt 13. The above procedure may be used whether both sheets 36, on drum 30, are receiving the same image or a different image. As each sheet 36 is released, by releasing the vacuum at ports 61 or 62 during the skip frame, it exits the nip of transfer station 32 and is deposited onto conveyor 40. While on conveyor 40 the linear exit speed of sheet 36 from transfer station 32 is reduced to match the throughput speed of fuser station 46. Overlap of sheet 36, after exiting the nip of transfer station 32, even though traveling at a slower rate of speed, is prevented, since the movement of any sheet 36 along conveyor 40, which has a transport length of 13.5 inches, takes less time than the movement of any sheet 36 making two and one half-revolutions with two-up drum 30.

Upon entering fuser station 46, sheet 36 is fused by the slower moving fuser station 46. With the above type of sequencing fusing station 46 is easily regulated to provide consistent heating energy and fusing oil expenditures and thereby produce a better image quality consistency both as to each individual output copy and the copy-to-copy output. In addition, this uniform output rate of copier 10 eliminates any confusion as to when the copy operation is complete or a jam has occurred, which was not the case in the non-uniform prior art output rate.

It is emphasized that while the above described system was described in relation to a four color toning system, such a skip sequencing system may be used with a three and two color toning system and numerous changes may be made in the above described system without departing from the teachings of the invention. It is intended that all of the matter contained in the foregoing description, or shown in the accompanying drawings, shall be interpreted as illustrative rather than limiting.

We claim:

1. A receiver transport sequencing system for use with printers, copiers, and like devices having a two up transfer station for transferring developed images, from a first movable member having a series of image frames, to a series of receivers, said transport sequencing system comprising:

means for delivering each receiver of the series of receivers to the transfer station separated by an interval of at least two image frames, means for transferring, at the transfer station, the developed images, from the image frames, in timed registration to the receivers, means for releasing the receivers at a first linear speed from the transfer station, a fuser station for fusing the transferred images to the receivers, means for conveying the receivers from the transfer station to the fuser station, means for releasing the fused receivers at a second linear speed from the fuser station, and means for synchronizing the delivery of the receivers to the transfer station, movement of the receivers in the transfer station, the release of the receivers from the transfer station and movement of the receivers on the conveying means to the fusing station.

2. The receiver transport system of claim 1 wherein the conveying means has an effective length of less than two receivers.

3. The receiver transport system of claim 1 wherein each receiver has a sequential position in the series of receivers, and the means for delivering each receiver of the series of receivers to the transfer station includes, in a four toner system, means for delivering the receivers to the transfer station during image frames designated $5n-4$, where n represents the position of each receiver of the series of receivers.

4. The receiver transport system of claim 1 wherein the means for releasing the receivers at a first linear speed from the transfer station includes means for releasing the receiver during a skip frame.

5. A method for sequencing a series of receivers to receive developed images from a first movable member having a series of image frames, said sequencing method comprising the steps of:

delivering each receiver of the series of receivers to a transfer station separated by an interval of at least two image frames, transferring, at the transfer station, the developed images in timed registration to the receivers, releasing the receivers at a first linear speed from the transfer station, conveying the receivers from the transfer station to a fuser station to fuse the developed images to the receivers, releasing the fused receivers from the fuser station at a second linear speed and synchronizing the delivery of the receivers to the transfer station, movement of the receivers in the transfer station, the release of the receivers from the transfer station and movement of the receivers during conveyance to the fusing station.

6. The sequencing method according to claim 5 wherein the delivering step includes securing each receiver to a second movable member and retaining the receivers for movement with said second movable member for transporting the receivers into transfer contact with the frames of developed images on the first movable member.

7. The sequencing method according to claim 5 wherein each receiver has a position in the series of receivers and the step of synchronizing the release of the receivers from the transfer station, for a four toner system, includes a step of releasing the receivers sequentially from the transfer station during image frames designated $5n[+]-4$, where n represents the position of each receiver of the series of receivers.

8. The sequencing method according to claim 5 wherein the step of synchronizing the movement of the receivers in the transfer station includes a step of releasing the receivers from the transfer station during a skip image frame.

9. The sequencing method according to claim 5 wherein each receiver has a position in the series of receivers and the step of synchronizing the delivering of the receivers to the transfer station for a four toner system includes the step of delivering the receiver during image frames designated 5n−4, where n represents the position of each receiver of the series of receivers.

10. The sequencing method according to claim 6 wherein the synchronizing step for movement of the receivers in the transfer station includes a step of maintaining the receivers conformed to the second movable member during image transfer.

11. The sequencing method according to claim 5 including the step of releasing the receivers from the transfer station and releasing the fused receivers from the fuser station at an interval constant to both.

12. A receiver transport sequencing system for a two up transfer station for transferring developed images, from a first movable member having a series of image frames, to a series of receivers, said transport sequencing system comprising:

means for delivering each receiver of the series of receivers to the transfer station separated by an interval of at least two image frames, means for transferring, at the transfer station, the developed images, from the image frames, in timed registration to the receivers and means for synchronizing the delivery of the receivers to the transfer station and movement of the receivers in the transfer station.

13. The receiver transport system of claim 12 wherein each receiver has a position in the series of receivers and the means for delivering each receiver of the series of receivers to the transfer station includes, in a four toner system, means for delivering the receivers to the transfer station during image frames designated 5n−4, where n represents the position of each receiver of the series of receivers.

14. A method for sequencing a series of receivers to receive toner images from a first movable member having a series of image frames containing toner images, with adjacent toner images being intended for different receivers, said sequencing method comprising the steps of:

delivering each receiver of the series of receivers to a transfer station separated by an interval of at least two image frames, transferring, at the transfer station, the toner images in timed registration to the receivers and synchronizing the delivery of the receivers to the transfer station and, movement of the receivers in the transfer station.

15. The sequencing method according to claim 14 wherein each receiver has a position in the series of receiver and the step of synchronizing the delivering of the receivers to the transfer station for a four toner system includes the step of delivering the receiver during image frames designated 5n−4, where n represents the position of each receiver of the series of receivers.

16. A combination image formation and receiver transport sequencing method for use with image forming apparatus having a two-up transfer member movable through an endless path for transfer in registration of a plurality of single color images forming first and second multicolor images, the single color images originally being formed as a series of single color images on an image member, said method comprising:

forming the single color images on the image member in an order which alternates between single color images for the first multicolor image and single color images for the second multicolor image, said forming step offsetting the single color images for the second multicolor image on the image member by at least two image areas from comparable single color images for the first multicolor image, and delivering each receiver of a series of receivers to the transfer member separated by an interval corresponding to the offset to more evenly space the transport of receivers to and from the transfer member.

* * * * *